United States Patent [19]

Fife

[11] 3,982,993

[45] Sept. 28, 1976

[54] PREPARATION OF A WAX CONTAINING PAPER SHEET

[75] Inventor: Rodger L. Fife, Cupertino, Calif.

[73] Assignee: Georgia-Pacific Corporation, Portland, Oreg.

[22] Filed: Sept. 8, 1975

[21] Appl. No.: 610,937

[52] U.S. Cl. ..... 162/158; 162/164 EP; 162/166; 162/168 N; 162/172

[51] Int. Cl.[2] ..... D21D 3/00

[58] Field of Search ..... 162/166, 167, 172, 158 N, 162/158 R, 164 R, 164 EP, 168 N, 168 R; 8/185, 189; 106/270, 271, 163 R; 260/307 A, 307 R, 67 FP, 67.5, 28, 29.2 N, 29.4 R, 30.4 N, 849, 851, 67.6 R, 67.6 C, 635 N

[56] References Cited

UNITED STATES PATENTS

| | | | |
|---|---|---|---|
| 2,186,894 | 1/1940 | Brodersen | 8/189 |
| 2,327,162 | 8/1943 | Baldwin et al. | 8/189 |
| 2,352,152 | 6/1944 | Kaplan | 8/189 |
| 2,484,315 | 10/1949 | Scott | 162/167 |
| 2,601,597 | 6/1952 | Daniel et al. | 162/172 |
| 3,483,077 | 12/1969 | Aldrich | 162/172 |

*Primary Examiner*—S. Leon Bashore
*Assistant Examiner*—Peter Chin
*Attorney, Agent, or Firm*—Peter P. Chevis

[57] ABSTRACT

A process for treatment of a cellulosic paper sheet in which the cellulosic fibers are treated with a polyamine or polyamide and a mixture of wax emulsion, urea-formaldehyde and an aldehyde donor such as a tris nitromethane or an oxazolidine.

12 Claims, No Drawings

PREPARATION OF A WAX CONTAINING PAPER SHEET

This invention pertains to a paper sheet and a process for its preparation. More particularly, it pertains to a paper sheet which has been treated with a polyamine or polyamide wet-strength resin and a mixture of a wax emulsion, urea-formaldehyde, and an aldehyde donor to improve the water resistance, and the process for its preparation.

In many applications, it is often very desirable to have paper products possessing a certain stiffness or hardness and resistance to high humidity and water pick-up. For example, in manufacture of containers used for produce, such as vegetables and fruits, it is desirable to employ a paperboard or corrugating medium having a high degree of stiffness and resistance to high humidity to which the containers are frequently exposed. The paper products or boards used in container manufacture usually contain from 7 to 10 percent by weight of moisture which may increase to above 30 percent upon exposure to high humidity or an environment of high moisture content. With the high increase in moisture content, the container generally loses the major portion of its rigidity and strength. Even though the container may retain sufficient strength to hold the products packed in the container, it generally does not have sufficient rigidity and strength for stacking of the containers or to withstand the normal handling involved in shipment.

In addition to obtaining a paper sheet having the desirable resistance to high humidity and water pick-up, the paper sheet must have a good machineability not only in its preparation, but also when used in lamination or upon being corrugated in the preparation of paper sheet or board desirable for container manufacture. High-speed machinery is used and the paper sheet or any treatments to which it's exposed must lend itself to functioning properly under the high speed operation, such as not sticking to the rolls or having any of the treatment chemicals deposit out upon the equipment. Further, in the formation of a paper sheet in the paper machine, a certain amount of the cellulosic fiber, especially the "fine" or small fibers, are not recovered in the paper sheet but pass through and remain in the process and white water where it is present as a pollutant. Thus, it is greatly desirable to have a process for treatment of paper sheet which not only improves the moisture resistance but also contributes to the machineability of the paper sheet and to the removal or retention of the fines in the paper sheet.

It is, therefore, an object of this invention to provide a paper sheet having improved water resistance. A further object is to provide a paper sheet which has good machineability and may be employed in high speed operation in the formation of the sheet and its use in carton preparation. Another object is to provide a process in paper sheet manufacture for treating a slurry of cellulose fiber to impart the desired hardness and resistance to moisture to the paper sheet to make the paper sheet suitable for container manufacture for use under high humidity conditions. A still further object is to provide a process to increase the fiber pick-up in the sheet formation and minimize the cellulosic fibers passing through to remain in the process and white water.

The above and other objects are attained according to this invention by treating the cellulosic fibers in an aqueous slurry with from ½ to 10 pounds per ton of the cellulosic fiber on a dry basis with a thermosetting, cationic polyamine or polyamide wet-strength resin and subsequently adding polyamine or polyamide wet-strength resin and subsequently adding to the slurry of from 0.5 to 10 pounds per ton of dry cellulosic fiber in the slurry of a stabilizer comprising a mixture of an aqueous wax emulsion containing from 25 to 60 percent wax and, based upon the weight of the wax, of from 10 to 60 weight percent of a water-soluble, thermosetting urea-formaldehyde resin and from 20 to 90 weight percent of an aldehyde donor selected from the group consisting essentially of tris (hydroxymethyl) nitromethane and mono- and bicyclic oxazolidines and mixtures thereof where the mono- and bicyclic oxazolidines have formulas of:

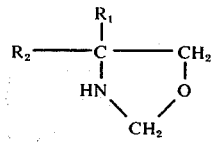

(1)

where $R_1$ and $R_2$ represent alkyl radicals of from 1 to 2 carbon atoms, and

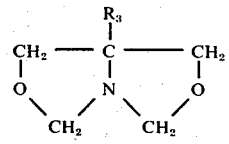

(2)

where $R_3$ represents an alkyl or hydroxyalkyl radical of from 1 to 2 carbon atoms.

After the addition of the mixture of aqueous wax emulsion with the urea-formaldehyde resin and the aldehyde donor, the paper sheet is dewatered and dryed. The paper sheet so prepared has the desirable moisture resistance and machineability to permit the board to be processed on high speed machinery in the lamination or preparation of corrugated board or otherwise processed in container preparation.

The treatment of the aqueous slurry with a polyamine or polyamide wet-strength resin and with the stabilizer mixture may be carried out in most of the paper machines commonly used for paper sheet formation. The wet-strength resin may be conveniently added to the headbox so that the slurry may be thoroughly mixed with the wet-strength resin. The stabilizer mixture may then conveniently be added to the stock chest or machine chest. However, the additions may be made at other points in the machine as long as the wet-strength resin is added first to the slurry prior to the addition of the stabilizer. Addition of the stabilizer prior to addition of the wet-strength resin may result in some of the constituents of the stabilizer depositing out on the wire or other parts of the paper machine. While the retention time after the addition of the wet-strength resin and the stabilizer is not critical, generally it is desirable to provide a hold time of at least 5 minutes in the slurry prior to the sheet formation. Usually upon addition of the wet-strength resin to the headbox and the addition of the stabilizer mixture the normal hold time provided in the machine or stock chest are sufficient to obtain attachment and retention by the cellulosic fibers of substantially all of the additives used.

The wet-strength resins used in this invention are the thermosetting cationic polyamine or polyamide wet-strength resins which are commonly used in papermaking. Most of these resins are reaction products of polyamines and polyamides with halohydrins, such as epichlorohydrin. Illustrative examples of the polyamine, cationic wet-strength resins are those described in U.S. Pat. Nos. 2,969,302 and 3,248,353. Other polyamine wet-strength resins are described in U.S. Pat. No. 3,372,086 wherein the polyalkylene amine is prereacted with a dialdehyde prior to the condensation with epichlorohydrin. The polyamide wet-strength resins are preferred. An example of a resin of this type is described in U.S. Pat. No. 2,926,154 which is prepared by reacting a polyalkylene amine with a polybasic acid prior to cross-linking with a halohydrin, such as epichlorohydrin. Examples of other polyamide wet-strength resins are described in U.S. Pat. Nos. 3,269,852; 3,224,990; 3,248,280; and U.S. Pat. No. Re. 26,018, which are prepared similarly. Only a relatively small amount of the wet-strength resin has to be used. Preferably the amount of the wet-strength resin added is in the range of from 1 to 5 pounds of wet-strength resin per ton of cellulose fiber on a dry basis. The amount, however, may be increased up to and above 10 pounds per ton or decreased to about ½ pound per ton of dry fiber at which rate appreciable enhancement of the paper sheet is still obtained.

In preparation of the stabilizer mixture, generally the wax emulsion is intermixed with the aldehyde donor and urea formaldehyde resin prior to addition to the slurry. The wax emulsion used is of the type commonly used for paper treatment or coating which is a paraffin wax having a melting point in the range of 52° to 58°C. Commercially available paper-grade wax emulsions may be employed, or the emulsion may be prepared by heating the wax having the proper melting point and emulsifying it with hot water employing known emulsifying agents. The wax emulsion generally contains from 25 to 60 percent wax dispersed in a particle size of from 1 to 3 microns. When the wax emulsion is prepared, it is generally preferred to add from 0.05 to 5 percent by weight of the wax of a lignosulfonate dispersant which enhances the emulsion. After addition of the lignosulfonate dispersant, the emulsion may be mixed from about ½ to 2 hours in air or under non-oxidizing conditions, such as in presence of carbon dioxide by bubbling the gas through the mixture. The mixing decreases somewhat the viscosity and surface tension of the wax emulsion. Apparently the wax in the stabilizer does not soften the paper sheet but provides sufficient "fluff-out" to the sheet to give it good machine runability.

The aldehyde donors which may be used in preparation of the stabilizer are tris (hydroxymethyl) nitromethane, monocyclic oxazolidines having the formula:

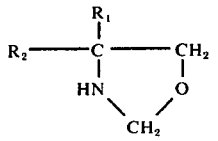

where $R_1$ and $R_2$ represent alkyl radicals of from 1 to 2 carbon atoms, and bicyclic oxazolidines of formula:

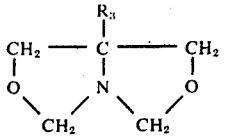

where $R_3$ represents an alkyl or hydroxyalkyl radical of from 1 to 2 carbon atoms. The monocyclic oxazolidine and the tris (hydroxymethyl) nitromethane are more reactive then the bicyclic oxazolidines so that it is generally desirable to use a mixture to obtain a product which is relatively stable at room temperature but reactive at temperatures normally encountered in dewatering and drying of the paper sheet. Preferably, a mixture of bicyclic oxazolidines in combination with tris (hydroxymethyl) nitromethane is used. The preferred mixture of the bicyclic oxazolidines is a mixture of an oxazolidine where $R_3$ represents an ethyl group with an oxazolidine where $R_3$ is a hydroxymethyl group. The amount of the aldehyde donor or mixtures of aldehyde donors added can be varied from about 20 to 90 weight percent of the wax used. Preferably the amount used is in the range of around 35 to 60 percent of the wax.

A review of oxazolidine chemistry is given in *Chemical Reviews* 53, 309–352 (1953) and a method for the preparation of the bicyclic oxazolidines is disclosed in *J. M. Chem. Soc.* 67, 1515–1519.

The urea-formaldehyde resin used is a condensation product of urea with formaldehyde normally used in preparation of adhesives. The resins are usually prepared by reaction of from 0.8 to 3 moles, preferably from 1.5 to 2, of formaldehyde per mole of urea under acidic conditions in an aqueous medium. Usually the condensation is advanced to an extent that the urea-formaldehyde resin as a neutralized solution at a pH in the range of 7 to 10 containing about 65 weight percent resin, has a viscosity in the range of 200 to 1500 centipoises, preferably 300 to 1000 centipoises. The resin is generally added to the stabilizer mixture in an amount of from 10 to 60 weight percent of the wax in the mixture.

While the wax emulsion, aldehyde donor and urea-formaldehyde resin may be intermixed in any order, generally a portion of the aldehyde donor is added to the urea-formaldehyde resin prior to addition of the resin to the mixture. When the preferred mixture of aldehyde donors is used, generally the bicyclic oxazolidines are added to the wax emulsion and the tris (hydroxymethyl) nitromethane is mixed with urea-formaldehyde resin. The urea-formaldehyde resin is preferably neutralized to a pH of 6 to 8 by addition of sodium hydroxide prior to addition of the tris (hydroxymethyl) nitromethane which is generally added in an amount of from 5 to 40 weight percent of the urea-formaldehyde resin. After intermixing the constituents, additional water may be added to dilute the stabilizer. The stabilizer is usually added to the slurry in amount of 0.5 to 10 pounds of the stabilizer solids per ton of dry cellulosic fiber. Since relatively a small amount of the stabilizer is used, mixtures of the stabilizer containing from 10 to 15 percent solids may be conveniently employed.

To illustrate the invention, a liner board was prepared on a cylinder machine wherein the wet-strength resin and the wax mixture were used. The wet-strength resin was a cationic polyamide thermosetting resin prepared according to that described in U.S. Pat. No. 2,926,154. Instead of using commercially available paper-grade wax emulsion, the emulsion was prepared by emulsifying paraffin wax which had a melting point of about 54°C. The wax was heated to about 95°C and emulsified with heated water. A quaternary ammonium chloride emulsifying agent was used which is sold under the trademark of Arquad C-50. Half of the emulsifying agent was added to the water and the remainder to the heated paraffin prior to emulsifying the mixture. In addition to the quaternary ammonium salts, other known emulsifying agents such as polyethoxylated amines and diamines and fatty acids may be used. The ratio of wax and water used were such that a wax emulsion of about 35 weight percent wax was obtained. The emulsion was cooled to room temperature, and about half a pound of a fermented calcium base spent sulfite liquor to 5 gallons of the emulsion was added. After addition of the lignosulfonate dispersant, the mixture was mixed for about ½ hour and then gradually mixed for additional 2 hours under inert conditions by bubbling carbon dioxide through the mixture. The wax emulsion obtained had wax particle size of about 1 to 3 microns. To 5 gallons of the wax emulsion, 1 gallon each of aqueous 50 percent solutions of two bicyclic oxazolidines, one having an ethyl radical substituent and the other a hydroxymethyl radical, was intermixed. One gallon of a urea-formaldehyde resin containing 65 percent urea-formaldehyde solids was neutralized to a pH of about 7 and mixed with about 1¼ pounds of tris (hydroxymethyl) nitromethane as a 50% aqueous solution prior to addition to the wax emulsion. An additional 15 gallons of water were then added to obtain the final mixture containing about 12.5% solids. The mixture was metered into the headboxes of the cylinder machine at a rate of 25 to 30 millimeters per minute which represented about 2 pounds of stabilizer solids per ton of dry fiber. The wet-strength resin as a solution was likewise added at a rate of 25 to 30 millimeters per minute at a headbox ahead of the point of addition of the stabilizer which rate represented the addition of 2 pounds of the wet-strength resin per ton of cellulosic fiber on a dry basis. Upon addition of the wet-strength resin and the wax mixture to the paper machine, the fines in the white water were reduced to about 500 parts per million of suspended solids. Without the use of the additives, the suspended solids were in the range of 1500 to 2500 parts per million.

From the liner board prepared, 12 by 12 inch samples were cut from the rolls and placed in an oven and heated to 82°C for 5 minutes. After heating at 82°C, two 6 by 6 inch specimens were cut from the bottom edge of the larger samples and subjected to a water immersion test similar to that described in Tappi test T-491 su-63 except that the samples were immersed in four inches of tap water in a bucket and permitted to soak for 60 minutes prior to removing, blotting to remove the excess water and then weighing. In the test performed, it was found that in the water immersion test, the samples treated with the wet-strength resin and the wax emulsion increased in water content about 25 percent. Without the treatment, the water pick-up ranged from 30 to 40 percent. The weight of the 6 by 6 inch samples likewise increased by about 5 to 6 percent when the slurry was treated with the wet-strength resin and wax emulsion mixture.

What is claimed is:

1. In a process for the preparation of a paper sheet by dewatering a slurry of cellulosic fibers, the improvement which comprises treating the cellulosic fibers in the slurry with from 0.1 to 5 pounds per ton of the cellulosic fibers on a dry basis with a thermosetting, cationic polyamine or polyamide wet-strength resin, subsequently adding to the slurry of from 0.5 to 10 pounds per ton of dry cellulosic fiber in the slurry of a stabilizer comprising a mixture of an aqueous wax emulsion containing from 25 to 60 weight percent wax and, based upon the weight of the wax, of from 10 to 60 weight percent of a water-soluble, thermosetting urea-formaldehyde resin and from 20 to 90 weight percent of an aldehyde donor selected from the group consisting essentially of tris (hydroxymethyl) nitromethane, mono- and bicyclic oxazolidines and mixtures thereof, said mono- and bicyclic oxazolidines having formulas of:

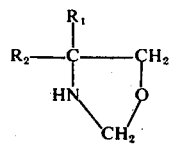

(1)

where $R_1$ and $R_2$ represent alkyl radicals of from 1 to 2 carbon atoms, and

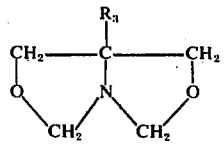

(2)

where $R_3$ represents an alkyl or hydroxyalkyl radical of from 1 to 2 carbon atoms, dewatering the paper sheet, and drying the paper sheet.

2. A process according to claim 1 wherein the cationic wet strength resin is a polyamine resin.

3. A process according to claim 1 wherein the wet strength resin is a polyamide resin prepared by reacting a polybasic acid with polyalkylene amine and cross-linking the reaction product with a halohydrin.

4. A process according to claim 3 wherein the wax emulsion is of a paraffin wax, having a melting point in the range of 52° to 58°C.

5. A process according to claim 4 wherein the stabilizer is prepared by mixing into a wax emulsion from 35 to 60 weight percent, based upon the weight of the wax, of a bicyclo oxazolidine aldehyde donor having formula:

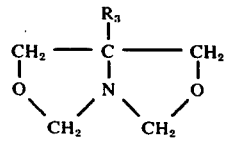

where $R_3$ is an alkyl or a hydroxyalkyl radical of from 1 to 2 carbon atoms.

6. A process according to claim 5 wherein the stabilizer is prepared by intermixing from 25 to 50 weight percent, based upon the wax content, of a urea-formaldehyde resin to which from 5 to 40 weight percent, based upon the urea-formaldehyde resin, of tris (hydroxymethyl) nitromethane has been added.

7. A process according to claim 6 wherein the bicyclo-oxazolidine aldehyde donor is a mixture of a bicyclo-oxazolidine of the formula where $R_3$ represents a ethyl radical with a bicyclic-oxazolidine of the formula where $R_3$ is a hydroxymethyl radical.

8. A process according to claim 7 wherein the wax emulsion contains from 0.1 to 2 percent by weight, based upon the wax, of a lignosulfonate.

9. A paper sheet prepared by the process of claim 1.

10. A paper sheet prepared by the process of claim 3.

11. A paper sheet prepared by the process of claim 7.

12. A paper sheet prepared by the process of claim 8.

* * * * *